US009943112B2

(12) United States Patent
Liu

(10) Patent No.: US 9,943,112 B2
(45) Date of Patent: Apr. 17, 2018

(54) ELECTRONIC CIGARETTE HAVING A BOTTLE CONFIGURED FOR STORING THE TOBACCO OIL

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/314,109

(22) PCT Filed: May 28, 2014

(86) PCT No.: PCT/CN2014/078665

§ 371 (c)(1),
(2) Date: Nov. 28, 2016

(87) PCT Pub. No.: WO2015/180072

PCT Pub. Date: Dec. 3, 2015

(65) Prior Publication Data

US 2017/0196264 A1 Jul. 13, 2017

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
None
See application file for complete search history.

(56) References Cited

U.S. PATENT DOCUMENTS

2013/0168880 A1* 7/2013 Duke ..... A24F 47/008 261/78.2

FOREIGN PATENT DOCUMENTS

CN 102166044 A 8/2011
CN 203327954 U * 12/2013 ..... A24F 47/00
(Continued)

OTHER PUBLICATIONS

International Search Report of PCT Patent Application No. PCT/CN2014/078665 dated Jan. 28, 2015.

*Primary Examiner* — Tho D Ta

(57) ABSTRACT

An electronic cigarette comprises a main body. A smoking end, an atomization assembly for atomizing tobacco oil, and a battery assembly for powering the atomization assembly are arranged on the main body. A bottle for storing the tobacco oil is arranged at one end of the main body, away from the smoking end. The atomization assembly is arranged between the smoking end and the bottle. The bottle and the battery assembly are in parallel. An electrical connection component is arranged between the battery assembly and the atomization assembly. One end of the electrical connection component is connected to the battery assembly while the other end of the electrical connection component is resiliently abutted against a side wall of the atomization assembly. Easy assembly, stable and reliable electrical connection, and a great reduction to the possibility that the user sucks the tobacco oil are realized in the electronic cigarette.

18 Claims, 11 Drawing Sheets

(56) References Cited

FOREIGN PATENT DOCUMENTS

| | | | | | |
|---|---|---|---|---|---|
| CN | 203482901 | U | | 3/2014 | |
| WO | WO2012/129812 | A1 | * | 10/2012 | ..... A24F 47/00 |

* cited by examiner

ELECTRONIC CIGARETTE HAVING A BOTTLE CONFIGURED FOR STORING THE TOBACCO OIL

FIELD OF THE INVENTION

The present invention relates to the field of electronic commodity, and more particularly to an electronic cigarette.

BACKGROUND OF THE INVENTION

The prior electronic cigarette includes an atomization assembly and a battery assembly. One end of the atomization assembly is used as a smoking end for the user to smoke. The cotton used for storing tobacco oil is contained in the atomization assembly that is coaxially arranged with the battery assembly, thus a configuration that the cotton and the battery assembly are serially arranged in a top and bottom way is formed. Firstly, the above top and bottom connecting way between the oil storage and the battery assembly makes the body of the electronic cigarette so long that it is inconvenient to be taken along. The tobacco oil is easy to permeate the battery assembly under gravity or capillarity, hence leading to short circuit of the battery assembly. Secondly, in the prior electronic cigarette, the smoke passageway for discharging the smoke runs through the cotton, which is easy to cause the tobacco oil to permeate the smoke passageway hence leading to oil leakage, and the heat of the smoke to be absorbed by the tobacco oil of the cotton hence leading to condensation of the smoke. Thus, the circumstance that the user sucks the tobacco oil happens. Thirdly, since the cotton is contained in the atomization assembly, the tobacco oil is injected into the atomization assembly via refueling equipment when refueling the tobacco oil. Therefore, the tobacco oil is easy to be injected into the smoke passageway if the electronic cigarette is over refueled or oscillated, thus leading to a heating wire in the atomization assembly being submerged by the tobacco oil hence being unable to atomize the tobacco oil and leading to the tobacco oil being sucked by the user. Meanwhile, since the cotton is contained in the atomization assembly, the tobacco oil absorbed by the cotton is easily pulled into the smoke passageway under the clamping force of mouth when the user smokes, thus the user is easy to suck the tobacco oil. Fourthly, in the prior art, the atomization assembly is usually electrically connected to the electronic cigarette via an electrical wire. The conducting effect is unstable and inconvenient for assembling and replacing the atomization assembly.

SUMMARY OF THE INVENTION

Aiming at above defects in the prior art, the technical problem of the present invention to solve is to provide an improved electronic cigarette.

The technical solution of the invention is as follows: in one aspect, the present invention discloses an electronic cigarette; the electronic cigarette comprises a main body; a smoking end, an atomization assembly configured for atomizing tobacco oil, and a battery assembly configured for powering the atomization assembly are arranged on the main body; a bottle for storing the tobacco oil is arranged at one end of the main body, the end is away from the smoking end; the atomization assembly is arranged between the smoking end and the bottle; the bottle is arranged in parallel with the battery assembly; and an electrical connection component is arranged between the battery assembly and the atomization assembly; one end of the electrical connection component is connected to the battery assembly, the other end of the electrical connection component is resiliently abutted against the atomization assembly, the electrical connection component is configured for providing an electrical connection between the battery assembly and the atomization assembly.

In the electronic cigarette of the present application, the electrical connection component comprises a first electrode and a second electrode which are configured to be insulated from each other; one end of the first electrode is electrically connected to the battery assembly while the other end of the first electrode is resiliently abutted against a side wall of the atomization assembly; one end of the second electrode is electrically connected to the battery assembly while the other end of the second electrode is resiliently abutted against the side wall of the atomization assembly; the side wall of the atomization assembly is facing the battery assembly.

In the electronic cigarette of the present application, the battery assembly comprises a battery and a control circuit board connected to the battery; the first electrode and the second electrode both are electronically connected to the battery via the control circuit board.

In the electronic cigarette of the present application, the main body further comprises a support; the battery assembly is arranged in the support; the atomization assembly is arranged in one end of the support and the end of the support adjoins the smoking end;

the support comprises a baffle arranged between the battery assembly and the bottle; mounting holes corresponding to the first electrode and the second electrode respectively are defined on the baffle; the first electrode and the second electrode are movably mounted in corresponding mounting holes respectively.

In the electronic cigarette of the present application, the smoking end, the atomization assembly and the bottle are coaxially arranged; one end of the atomization assembly is inserted into the bottle; the atomization assembly comprises a first electrode component resiliently abutted against the electrical connection component.

In the electronic cigarette of the present application, the bottle comprises an opening into which the atomization assembly is inserted; the atomization assembly comprises an atomization cavity including a heating wire component, and an oil guiding mechanism inserted into the bottle and configured for guiding the tobacco oil to the heating wire component; the atomization cavity is arranged at an outside of the opening; the first electrode component configured to be hollow and electrically connected to the heating wire component is arranged on the atomization cavity; the first electrode component communicates with the atomization cavity.

In the electronic cigarette of the present application, the first electrode component comprises a first external electrode and a first internal electrode which are configured to be hollow and insulated from each other; the first internal electrode is partly inserted into the first external electrode; one end of the heating wire component is connected to the first internal electrode while the other end of the heating wire component is connected to the first external electrode; the first internal electrode is resiliently abutted against the first electrode and the first external electrode is resiliently abutted against the second electrode.

In the electronic cigarette of the present application, the oil guiding mechanism comprises an oil guiding tube and an oil latching part; the oil latching part is made of oil absorbing material and contained in the oil guiding tube; an outer circumferential surface of the oil latching part is fit to an inner circumferential surface of the oil guiding tube; the first external electrode is sheathed in one end of the oil guiding tube and the first external electrode is fit to the oil guiding tube; the second electrode is resiliently abutted against the first external electrode through being resiliently abutted against a side wall of the oil guiding tube.

In the electronic cigarette of the present application, the heating wire component is contained in the oil guiding tube; the first electrode component electrically connected to the battery assembly is inserted into one end of the oil guiding tube; the heating wire component is electrically connected to the first electrode component; a smoke passageway communicated with the smoking end is formed in the main body and is configured for discharging smoke atomized by the heating wire component.

In the electronic cigarette of the present application, the heating wire component comprises a liquid guiding part arranged in an extending way towards an axial direction of the oil guiding tube, and a heating wire wound around the liquid guiding part; one end of the liquid guiding part is abutted against the oil latching part; the heating wire is electrically connected to the first electrode component.

In the electronic cigarette of the present application, structures of the oil latching part and the liquid guiding part both are configured to be solid and cylindrical; an axis line of the oil latching part is configured to be superposition with or parallel to an axis line of the liquid guiding part; and cross sectional area of the oil latching part is bigger than cross sectional area of the liquid guiding part.

In the electronic cigarette of the present application, the first electrode and/or the second electrode are pogo pin electrodes or leaf spring electrodes.

In the electronic cigarette of the present application, the electronic cigarette further comprises a display panel configured for displaying information of the electronic cigarette; the display panel is arranged on the main body and electrically connected to the control circuit board.

In the electronic cigarette of the present application, the information of the electronic cigarette includes at least one of the following information: remaining capacity of the battery assembly, the number of puff from the electronic cigarette, the number of the electronic cigarette to be powered on, flavor of the tobacco oil and manufacturer.

In the electronic cigarette of the present application, the electronic cigarette further comprises a key component connected to the control circuit board; the key component is at least partially exposed from an outside wall of the electronic cigarette and is configured for controlling an electrical connection between the electrical connection component and the battery according to an external trigger signal to control atomization of the atomization assembly to the tobacco oil in the bottle.

In the electronic cigarette of the present application, the bottle is detachably and externally arranged on the main body; the electronic cigarette further comprises an elastic part and a sheathing configured to protect the bottle; the sheathing is connected to the main body with a sliding connection; one end of the elastic part is connected to the sheathing while the other end of the elastic part is connected to the main body; in the process that the sheathing is slid from one terminal to the other terminal of a sliding path, the elastic part is configured to provide resilience in a direction toward the other terminal of the sliding path for the sheathing.

In the electronic cigarette of the present application, a sliding connecting mechanism is defined between the main body and the sheathing; the sliding connecting mechanism comprises a first coulisse arranged on the main body and a first sliding part arranged on the sheathing and inserted into the first coulisse; the first sliding part is configured to slide in the first coulisse in an axial direction of the first coulisse to form the sliding path.

In the electronic cigarette of the present application, a critical position is define between two terminals of the sliding path; when the first sliding part is positioned between one terminal of the sliding path and the critical position, the elastic part is configured to provide resilience in a direction toward the terminal for the sheathing; a connecting line between a connecting point connecting the elastic part to the main body and the critical position is perpendicular to an axis of the first coulisse.

In the electronic cigarette of the present application, the elastic part is in compressed state when the first sliding part is positioned at an upper end of the first coulisse.

In another aspect, the present invention further discloses an electronic cigarette comprising a main body; a smoking end, an atomization assembly configured for atomizing tobacco oil, and a battery assembly configured for powering the atomization assembly are arranged on the main body; a bottle for storing the tobacco oil is arranged at one end of the main body, the end of the main body is away from the smoking end; the atomization assembly is arranged between the smoking end and the bottle; the bottle is arranged in parallel with the battery assembly;

an electrical connection component is arranged between the battery assembly and the atomization assembly, one end of the electrical connection component is connected to the battery assembly, the other end of the electrical connection component is resiliently abutted against the atomization assembly, the electrical connection component is configured for providing an electrical connection between the battery assembly and the atomization assembly;

the battery assembly comprises a battery and a control circuit board connected to the battery; the electrical connection component is arranged at a side of the control circuit board, the side of the control circuit board is facing the atomization assembly; one end of the electrical connection component is electrically connected to the control circuit board while the other end of the electrical connection component is resiliently abutted against a first electrode component;

a sliding connecting mechanism is defined between the main body and a sheathing; the sliding connecting mechanism comprises a first coulisse arranged on the main body and a first sliding part arranged on the sheathing; the first sliding part is configured to slide in the first coulisse in an axial direction of the first coulisse to form a sliding path;

a critical position is define between two terminals of the sliding path; when the first sliding part is positioned between one terminal of the sliding path and the critical position, an elastic part is configured to provide resilience in a direction toward the one terminal for the sheathing; a connecting line between a connecting point connecting the elastic part to the main body and the critical position is perpendicular to an axis of the first coulisse;

the elastic part is in compressed state when the first sliding part is positioned at an upper end of the first coulisse; the main body further comprises a support; the battery assembly is arranged in the support; the atomization assembly is arranged in one end of the support and the end of the support adjoins to the smoking end; the bottle is detachably connected to the support; the smoking end, the atomization assembly and the bottle are coaxially arranged;

the support comprises a baffle, a first mounting part arranged at one side of the baffle and a second mounting part arranged at the other side of the baffle; the battery assembly is mounted in the first mounting part; the second mounting part is shaped to be hollow tubular; a second internal threaded joint is defined in one end of the second mounting part and the end of the second mounting part is close to the smoking end; a first internal threaded joint is defined in the other end of the second mounting part and the other end of the second mounting part is away from the smoking end; the bottle is screwed to the first internal threaded joint and the smoking end is screwed to the second internal threaded joint.

By implementing the electronic cigarette of the present invention, the following advantages can be obtained. Via the arrangement that the battery assembly is arranged in parallel with the bottle and the atomization assembly, and the arrangement that the resilient electrical connection component is arranged between the atomization assembly and the battery which are hence resiliently abutted against each other, easy assembly, convenient disassembly as well as stable and reliable electrical connection can be realized in the electronic cigarette. The electronic cigarette is well designed for short length, convenient to be taken along and strong mechanical strength. In additional, the diameter of this electronic cigarette is larger, hence the enjoyment for sucking and holding is increased and it is more suitable for satisfying the psychological need of the smokers who are used to the cigarette with large diameter such as cigar and the like. The electronic cigarette cannot be broken easily under external force. The case that the battery assembly is shorted under the influence of tobacco oil can be avoided. Since the bottle is arranged at one end of the main body and the end of the main body is away from the smoking end, the smoke doesn't flow through the oil stored region. Therefore, the damage that the user sucks tobacco oil caused by oil leakage due to the tobacco oil permeating the smoke passageway, caused by smoke condensation due to the heat of the smoke absorbed by the tobacco oil, and caused by the tobacco oil entering into the smoke passageway under extrusion, can be avoided effectively.

Moreover, since the bottle is detachably arranged in the atomizer, it is convenient for a user to refuel or replace tobacco oil with different flavor. Meanwhile, since the sheathing is connected to the main body via a sliding connection, the bottle can be protected from being broken when it is oscillated during transportation or in use. Since the elastic part can provide resilience in a direction toward the other terminal of the sliding path for the sheathing when the sheathing is slid from one terminal to the other terminal of the sliding path, it is convenient for using and operating and can prevent from a mistaken operation. Since the bottle is detachably arranged at the external of the main body, it is convenient to replace the bottle. As the bottle is away from the smoking end, it can prevent the user from sucking the tobacco oil and it can also prevent the smoking end from being polluted by the tobacco oil when refueling the tobacco oil to the bottle. In additional, since the sheathing is in an open or closed state and the elastic part is in a compressed state when the first sliding part of the electronic cigarette of the present application is positioned at each of the two terminals of the sliding path, the elastic part can provide resilience for the sheathing to keep the sheathing in the open or closed state, and further prevent the sheathing from being opened or closed by a mistaken operation.

BRIEF DESCRIPTION OF THE DRAWINGS

The present application will be further described with reference to the accompanying drawings and embodiments in the following. In the accompanying drawings.

DETAILED DESCRIPTION OF THE PREFERRED EMBODIMENT

To make the technical features, objective and effects of the invention more clearly understood, the invention is to be further described with reference to the accompanying drawings and embodiments.

Figure 1:
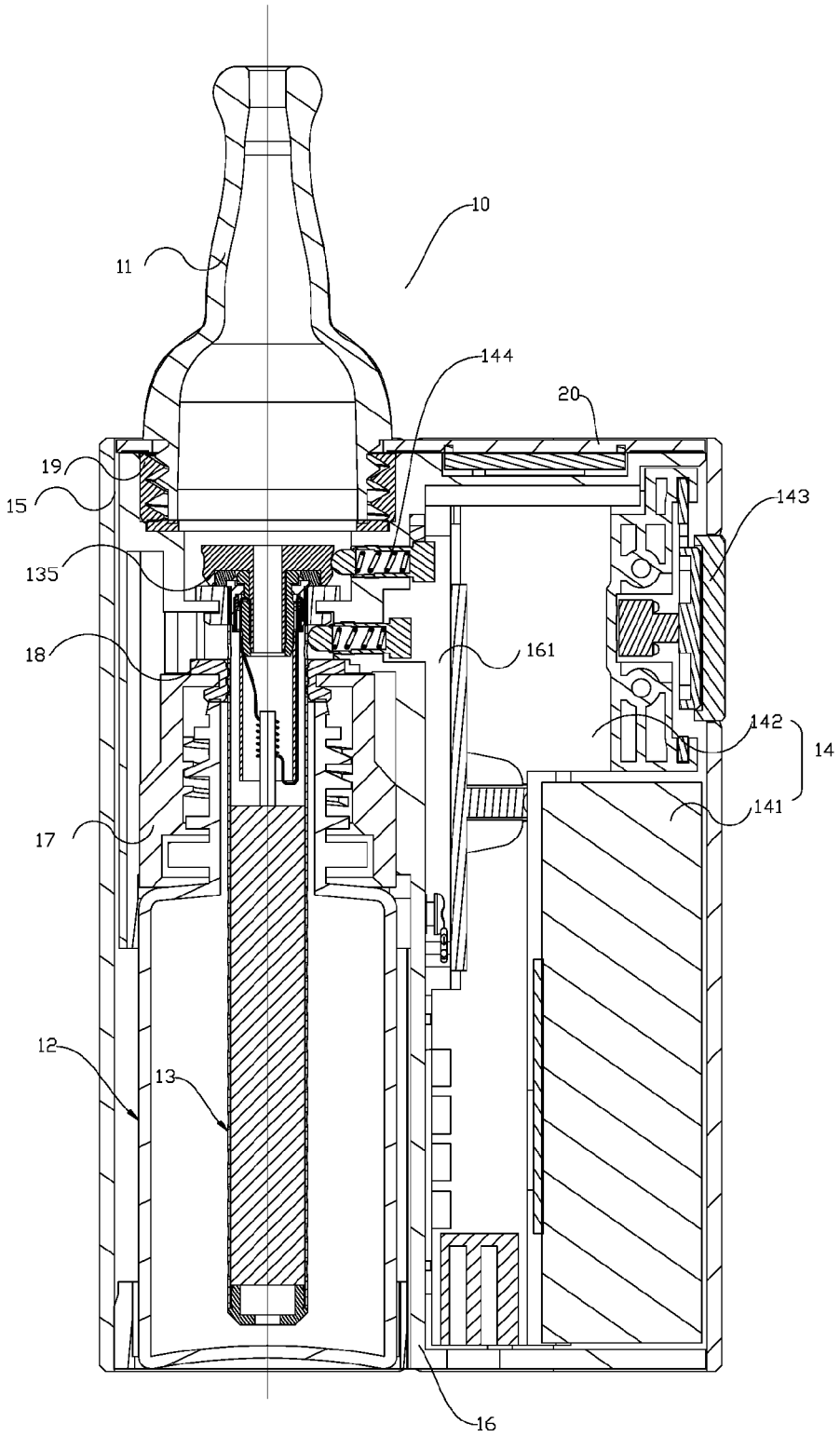
FIG. 1 illustrates a sectional view of an electronic cigarette in accordance with a first preferred embodiment of the present application.

FIG. 1 illustrates a sectional view of an electronic cigarette in accordance with a first preferred embodiment of the present application. The electronic cigarette comprises a main body 10. A smoking end 11 is arranged on the main body 10. A bottle 12 configured for storing tobacco oil is arranged at one end of the main body 10 and the end of the main body 10 is away from the smoking end 11. The main body 10 further comprises a battery assembly 14 arranged in parallel with the bottle 12. An atomization assembly 13 is arranged between the smoking end 11 and the bottle 12. An electrical connection component 144 is arranged between the battery assembly 14 and the atomization assembly 13. In the assembled electronic cigarette, one end of the electrical connection component 144 is electrically connected to the battery assembly 14 while the other end of the electrical connection component 144 is resiliently abutting against the atomization assembly 13, therefore the battery assembly 14 is electrically connected to the atomization assembly 13 to power the atomization assembly 13. Compared with the existing direct connection via a wire, it is more stable to realize the electrical connection between the atomization assembly 13 and the battery assembly 14 via the resilient electrical connection component 144. Moreover, the mistake that the wire is connected incorrectly can be avoided in assembling process and the assembling complexity can be reduced at the same time. Furthermore, the total length of the electronic cigarette can be reduced and it is convenient to be taken along due to the arrangement that the bottle 12 is arranged in parallel with the battery assembly 14.

Referring to FIG. 1, in this embodiment, the smoking end 11, the atomization assembly 13 and the bottle 12 are coaxially arranged. One end of the atomization assembly 13 is inserted into the bottle 12. A first electrode component 135 for resiliently abutted against the electrical connection component 144 is included in one end of the atomization assembly 13 and the end of the atomization assembly 13 is away from the bottle 12. Since the first electrode component 135 is away from the bottle 12, the damage to the first electrode component 135 from the tobacco oil in the bottle 12 due to the reasons such as gravity during use can be avoided effectively, thus the lifetime of the electronic cigarette is prolonged.

Furthermore, in this embodiment, the main body 10 further comprises a support 16 for containing the atomization assembly 13, the battery assembly 14 and the bottle 12. Referring to FIG. 1, a baffle 161 is formed longitudinally in the support 16. The support 16 is hence divided into two parallel cavities for containing the battery assembly 14 and the bottle 12 respectively. Mounting holes corresponding to the electrical connection component 144 are defined on the baffle 161. The electrical connection component 144 is mounted in the mounting holes and is fixed along the longitude of the baffle 161. Combining with FIG. 2, it is known that the electrical connection component 144 of the present embodiment comprises a first electrode 1440 and a second electrode 1441. Therefore, two mounting holes corresponding to the first electrode 1440 and the second electrode 1441 are defined on the baffle 161. The first electrode 1440 and the second electrode 1441 are respectively inserted into their own corresponding mounting holes and extended from the mounting holes to resiliently abut against the first electrode component 135.

The main body 10 further comprises a first internal threaded joint 17, a gasket 18 and a second internal threaded joint 19. The first internal threaded joint 17 is screwed to the bottle 12. The gasket 18 is arranged on the atomization assembly 13 and abutted against the opening of the bottle 12 to prevent from tobacco oil leakage. The second internal threaded joint 19 is arranged on one end of the support 16 and the end of the support 16 is close to the smoking end 11. The second internal threaded joint 19 is configured for being screwed the smoking end 11 into, thus it is easy to disassemble and assemble the smoking end 11.

The battery assembly 14 comprises a battery 141 and a control circuit board 142 connected to the battery 141. One end of the electrical connection component 144, away from the atomization assembly 13, is connected to the control circuit board 142, thus making the electrical connection component 144 connected to both of the positive and negative electrodes of the battery 141. In another unlimited embodiment of the present application, a display panel 20 is arranged on the support 16 and exposed from an outside of the main body 10. The display panel 20 is connected to the control circuit board 142. The display panel 20 may be a LED panel electrically connected to the control circuit board and used for displaying information of the electronic cigarette. The information of the electronic cigarette includes at least one of the following information: remaining capacity of the battery assembly, the number of puff from the electronic cigarette, the number of the electronic cigarette to be powered on, flavor of the tobacco oil and manufacturer. Adopting this solution, the users can be acquainted with their own consumption on tobacco and the electricity of the battery assembly 14 can be controlled as well, which is helpful for users to quit smoking and for improving user experience. Meanwhile, the user can choose the flavor of the tobacco or control smoking frequency etc. according to the information displayed.

In a further unlimited embodiment of the present application, a key component 143 connected to the control circuit board 142 is arranged on the support 16. The key component 143 is at least partially exposed from an outside wall of the electronic cigarette. The key component 143 is used for controlling an electrical connection between the electrical connection component 144 and the battery 141 according to an external trigger signal, thus controlling atomization of the atomization assembly 13 to the tobacco oil in the bottle 12.

Figure 2:
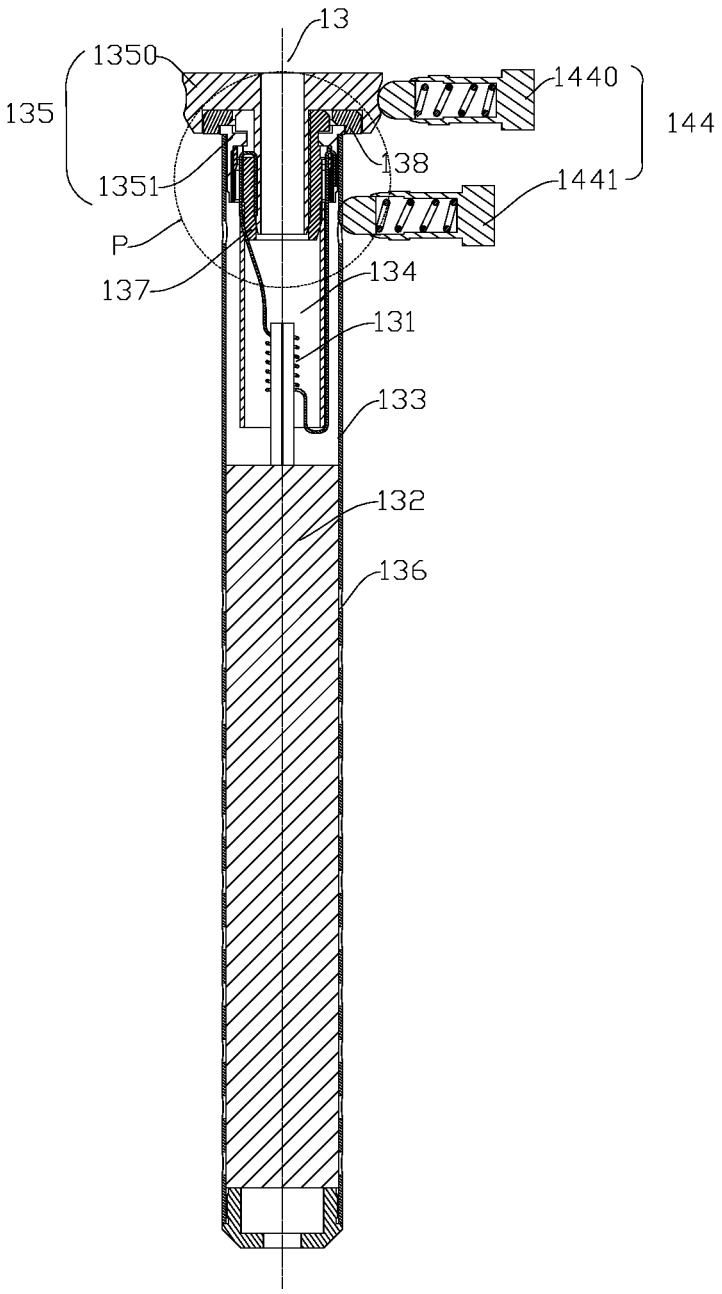
FIG. 2 illustrates a structure of a connection between an atomization assembly and an electrical connection component of the electronic cigarette shown in FIG. 1.

Referring to FIG. 2, in a preferred embodiment of the present application, the atomization assembly 13 comprises an atomization cavity 134 for containing a heating wire component 131, and an oil guiding mechanism inserted into the bottle 12 and configured for guiding the tobacco oil to the heating wire component 131. The oil guiding mechanism comprises an oil guiding tube 133 and an oil latching part 132 contained in the oil guiding tube 133. The first electrode component 135 configured to be hollow and electrically connected to the heating wire component 131, is arranged on the atomization cavity 134. The first electrode component 135 communicates with the atomization cavity 134. A smoking passageway is hence internally formed which is used for discharging the smoking atomized by the heating wire component 131. The smoking passageway is communicated with the smoking end 11. Since the smoking passageway in this embodiment doesn't run through the bottle 12, condensation of the smoke caused by heating absorbed by tobacco oil can hence be avoided and the phenomenon that the smoking passageway is blocked can be prevented.

The above oil guiding mechanism comprises the oil guiding tube 133 and the oil latching part 132 made of oil absorbing material and contained in the oil guiding tube 133. The corresponding electrical connection component 144 comprises a first electrode 1440 and a second electrode 1441 which are configured to be insulated from each other. One end of the first electrode 1440 is electrically connected to the battery assembly 14 while the other end of the first electrode 1440 is resiliently abutted against the first internal electrode 1350. One end of the second electrode 1441 is electrically connected to the battery assembly 14 while the other end of the second electrode 1441 is resiliently abutted against the first external electrode 1351. An outer circumferential surface of the oil latching part 132 is fit to an inner circumferential surface of the oil guiding tube 133. An opening communicated with the smoking end 11 is defined on one end of the oil guiding tube 133 and the end of the oil guiding tube 133 is close to the smoking end 11. The end of the oil guiding tube 133 with the opening is close to the heating wire component 131 while the other end of the oil guiding tube 133 is inserted into the internal of the bottle 12. An oil intake 136 is defined on a side wall of the oil guiding tube 133 in order to make the tobacco oil in the bottle 12 flow into the oil guiding mechanism through the oil intake 136. Preferably, the first electrode 1440 and/or the second electrode 1441 in this embodiment can be pogo pin electrodes or leaf spring electrodes, etc.

Figure 3:
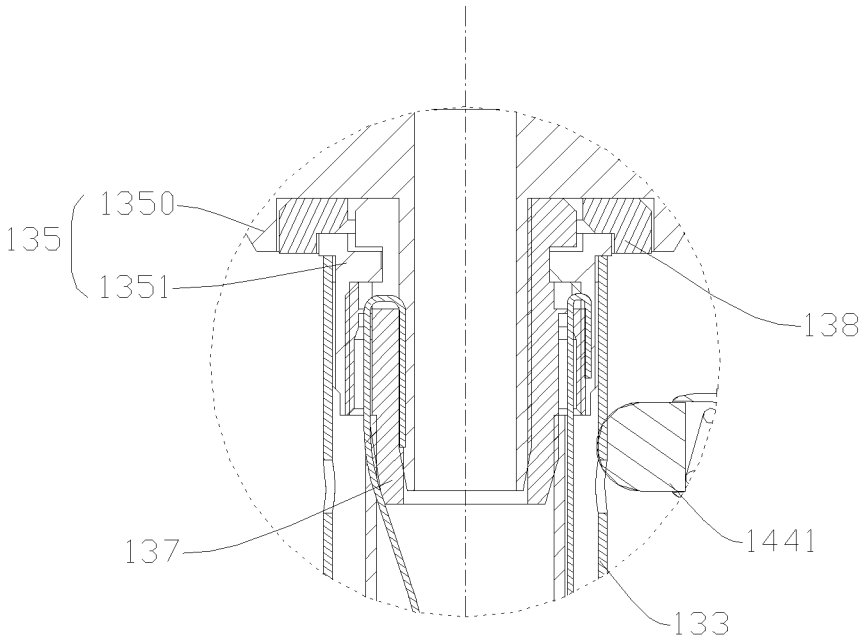
FIG. 3 illustrates an enlarged view of a P section shown in FIG. 2.

Referring to FIGS. 2 and 3, the first electrode component 135 comprises a first external electrode 1351 and a first internal electrode 1350 which are configured to be hollow and insulated from each other. The first internal electrode 1350 is partly inserted into the first external electrode 1351. An atomization base 137 is coaxially arranged between the first internal electrode 1350 and the first external electrode 1351. An insulator 138 is arranged in the connecting position between the oil guiding tube 133 and the first internal electrode 1350. The insulator 138 is used to realize insulation between the first internal electrode 1350 and the first external electrode 1351 at the position of the opening of the oil guiding tube 133. The atomization base 137 is used to realize the insulation between the first internal electrode 1350 and the first external electrode 1351 at the position of the internal of the oil guiding tube 133. One end of the heating wire component 131 is connected to the first internal electrode 1350 while the other end of the heating wire component 131 is connected to the first external electrode 1351. Preferably, one end of the heating wire component 131 is electronically connected to the first internal electrode 1350 via being clamped between the first internal electrode 137 and the atomization base 137 while the other end of the heating wire component 131 is electronically connected to the first external electrode 1351 via being clamped between the atomization base 137 and the first external electrode 1351. The electrical connection realized via above clamping connection is more convenient for disassembly compared with welding connection. The first external electrode 1351 is sheathed into one end of the oil guiding tube 133 and fit to the oil guiding tube 133. The second electrode 1441 is abutted against a side wall of the oil guiding tube 133 and thus is abutted against the first external electrode 1351 being. In another embodiment of the present application, the second electrode 1441 can be directly abutted against the external electrode 1351 via defining a hole on the oil guiding tube 133 to make the second electrode 1441 extend through the hole. Therefore, the specific configuration between the second electrode 1441 and the first external electrode 1351 is not limited as long as the electrical connection can be realized via resilient abutment.

Figure 4:
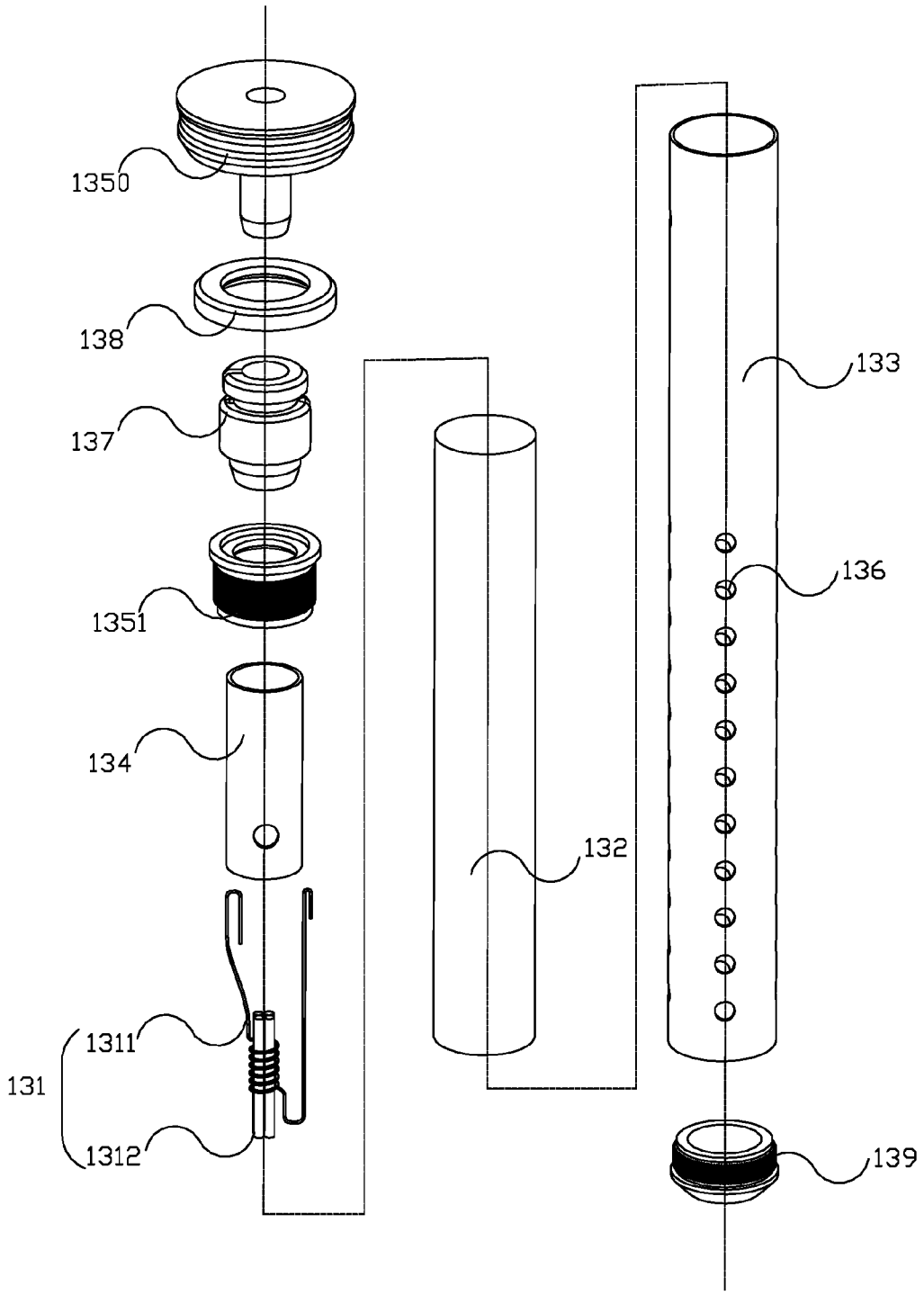
FIG. 4 illustrates an explored view of the atomization assembly shown in FIG. 2.

Referring the FIG. 4, the heating wire component 131 comprises a liquid guiding part 1312 extended in an axial direction of the oil guiding tube 133 and a heating wire 1311 wound around the liquid guiding part 1312. One end of the liquid guiding part 1312 is contacted with the oil latching part 132 and the heating wire 1311 is electrically connected to the first electrode component 135. The oil latching part 132 is made of oil absorbing material such as cotton, fiber etc. The outer circumferential surface of the oil latching part 132 is fit to the inner circumferential surface of the oil guiding tube 133, and it can hence prevent the tobacco oil from leaking from the oil guiding tube 133 when the electronic cigarette is put down. The effect of guiding oil is also great. The oil latching part 132 and the liquid guiding part 1312 are both configured to be solid and cylindrical. An axis line of the oil latching part 132 is configured to be superposition with or parallel to an axis line of the liquid guiding part 1312. The cross sectional area of the oil latching part 132 is bigger than that of the liquid guiding part 1312. Therefore, the structure of the oil transmitting path is configured to be stepwise, thus assuring that the liquid guiding part 1312 can obtain the tobacco oil needed from the oil latching part 132 whenever necessary. It can hence not only improve the quality of the smoke and prevent the heating wire component 131 from dry combustion but also prevent the tobacco oil in bottle 12 from leaking, thus assuring that the atomization assembly 13 produces smoke with stable quality. For a convenient assembly, the oil guiding tube 136 in this embodiment is configured to open at both ends and the end close to the bottle 12 is fastened to a cap 39 to prevent the tobacco oil in the bottle 12 from heavily permeating the oil latching part 132 via the opening of the oil guiding tube 133. Otherwise the taste will be influenced. Assuredly, the configuration of the atomization assembly 13 is not limited to above mentioned configuration as long as it can atomize the tobacco oil in bottle 12, which is not limited here.

Figure 5:
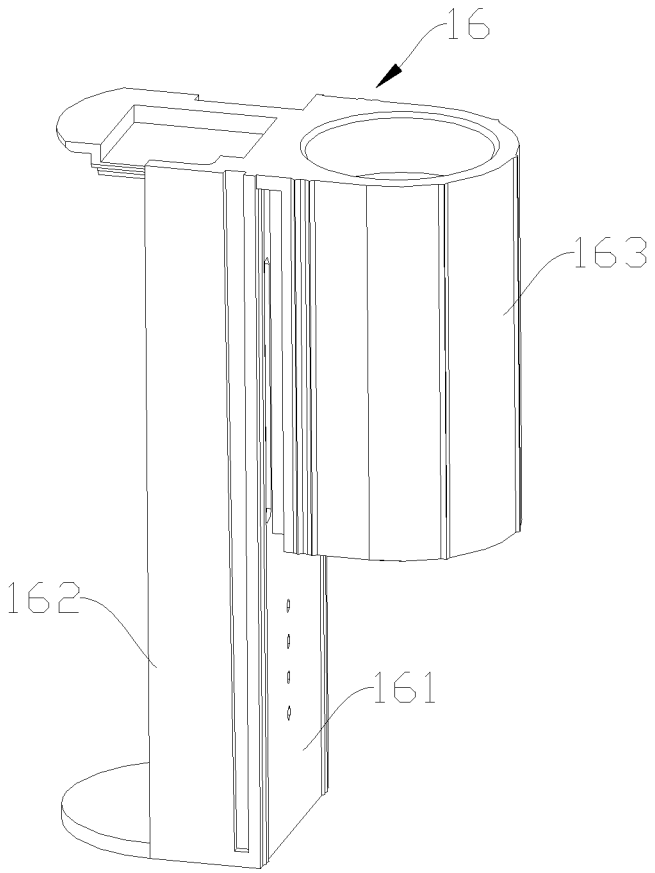
FIG. 5 illustrates a structure of a support of the electronic cigarette shown in FIG. 1.

Referring to FIG. 5, the support 16 comprises a baffle 161, a first mounting part 162 arranged at one side of the baffle 161 and used for mounting the battery assembly 14 and a second mounting part 163 arranged at the other side of the baffle 161. The shape of the baffle 161 is almost to be a rectangle. The battery assembly 14 is mounted in the first mounting part 162. A protective cap with a semicircle tubby shape is arranged at the outside of the first mounting part 162. The shape of the second mounting part 163 is almost to be a hollow tubular and it is arranged along the longitude of the baffle 161. The axial length of the second mounting part 163 is shorter than that of the baffle 161. Combining with the first internal threaded joint 17, the gasket 18 and the second internal threaded joint 19 shown in FIG. 1, the first internal threaded joint 17 screwed to the bottle 12 is fixedly clamped within one end of the second mounting part 163 and the end of the second mounting part is away from the smoking end 11. The gasket 18 is mounted between the oil guiding tube 133 of the atomization assembly 13 and the first internal threaded joint 17 in order to prevent from oil leakage. The second internal threaded joint 19 screwed to the smoking end 11 is mounted into one end of the second mounting part 163 and the end of the second mounting part 163 is close to the smoking end 11, thus making the disassembly and assembly easy. Without doubt, the battery assembly 14 is not limited to above mentioned configuration as long as it can power the atomization assembly 13, which is not limited here.

Figure 6A:
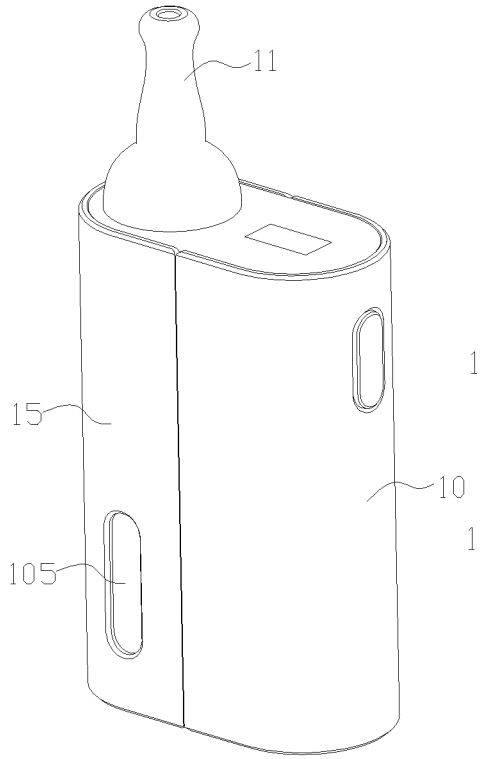
FIG. 6*a* illustrates a structure of an electronic cigarette when a sheathing is in a closed state in accordance with a second preferred embodiment of the present application.
Figure 6B:
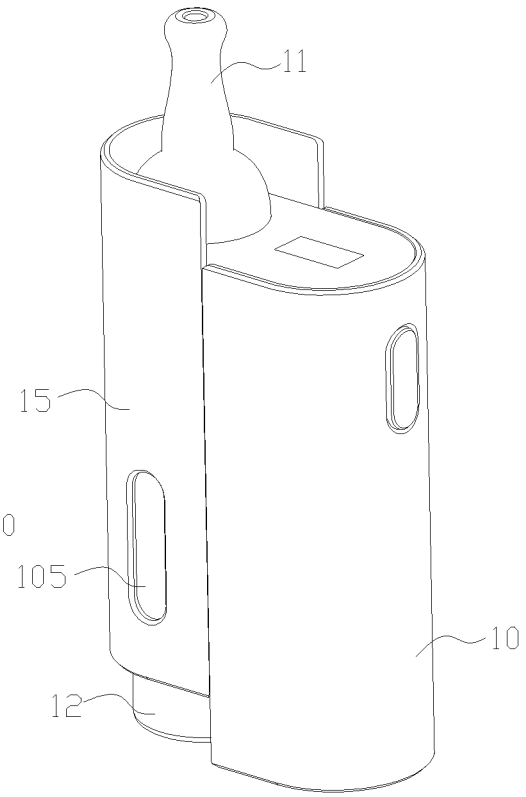
FIG. 6*b* illustrates a structure of the electronic cigarette when the sheathing is positioned in a critical position in accordance with the second preferred embodiment of the present application.
Figure 6C:
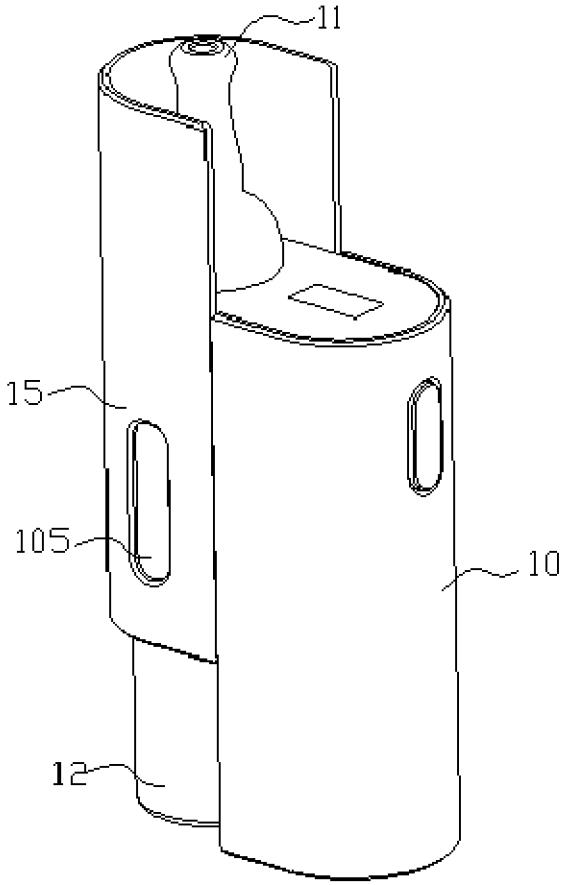
FIG. 6*c* illustrates a structure of the electronic cigarette when the sheathing is in open state in accordance with the second preferred embodiment of the present application.

Referring to FIGS. 6*a*, 6*b* and 6*c*, which show an electronic cigarette in accordance with another preferred embodiment. The electronic cigarette in this embodiment includes the technical feature that the electrical connection component 144 of the electronic cigarette shown in FIG. 1 is used to realize elastic electrical connection between the atomization assembly 13 and the battery assembly 14. The difference is that the bottle 12 of the electronic cigarette in this embodiment is detachably connected to the support 16 and is externally arranged on the main body 10. The electronic cigarette further comprises a sheathing 15 used for protecting the bottle 12 and connected to the main body 10 with sliding connection and an elastic part 30 (shown in FIG. 7). One end of the elastic part 30 is connected to the sheathing 15 while the other end of the elastic part 30 is connected to the main body 10. When the sheathing 15 is slid from one terminal to the other terminal of the sliding path, the elastic part 30 is configured to provide resilience in a direction toward the other terminal of the sliding path for the sheathing 15.

As the sheathing 15 is configured, it can protect the bottle 12 from damaging when the electronic cigarette is shaken in the process of transportation or use. In the process that the sheathing 15 is slid from one terminal to the other terminal of the sliding path, the elastic part 30 can provide resilience in a direction toward the other terminal of the sliding path for the sheathing 15, therefore, it is convenient for use, and it can also prevent from mistaken operation. Since the bottle 12 is detachably and externally arranged on the main body, it is convenient to disassemble and assemble the bottle 12. Since the bottle 12 is away from the smoking end 11, the user can be prevented from sucking the tobacco oil. Further, the smoking end 11 can be prevented from being polluted from the tobacco oil when refueling the bottle 12. Preferably, in this embodiment, the bottle 12 is made of transparent material and a scale is defined on the bottle 12. Correspondingly, an observation window is defined on the sheathing 15. The observation window is used for the user to observe the quantity of the tobacco oil in the bottle 12, thus making the user obtain a well acknowledgement to the quantity of the tobacco oil in the bottle 12 and refuel the tobacco oil in time. It should be understood that a cap for protecting the bottle 12 can also be detachably arranged at the bottom of the sheathing 15 to prevent the bottle 12 from broken.

A critical position is defined between two terminals of the sliding path of the sheathing 15. In FIG. 6*a*, the sheathing 15 is in a closed state. The sheathing 15 is positioned at one terminal of the sliding path. When the sheathing 15 is positioned between the one terminal and the critical position, the elastic part 30 provides resilience toward the one terminal for the sheathing 15. In FIG. 6*b*, the sheathing is positioned in the critical position in an open process or a closed process. In this time, the elastic part 30 provides no resilience in the direction of sliding path for the sheathing 15. In FIG. 6*c*, the sheathing 15 is in an open state. The sheathing 15 is positioned at the other terminal of the sliding path. When the sheathing 15 is positioned between the other terminal of the sliding path and the critical position, the elastic part 30 provides resilience toward the other terminal along the sliding path for the sheathing 15.

Therefore, when opening or closing the sheathing 15, the sheathing 15 can be opened or closed automatically as long as the sheathing 15 is pushed through the critical position. It possesses the advantageous of improving user experience. In additional, the distance between the connecting point between one end of the elastic 30 and the main body 10 and the connecting point between the other end of the elastic 30 and the sheathing 15 is shorted during the sheathing 15 sliding to the critical position in the process of opening or closing the sheathing 15. That is, the elastic part 30 is compressed. The elastic part 30 will hence hinder the movement of the sheathing 15, and thus the mistaken operation can be prevented. Since the bottle 12 is detachably and externally arranged on the main body, it is convenient to replace the bottle 12 or refuel tobacco oil to the bottle 12. Since the bottle 12 is arranged at the end away from the smoking end 11, the user can be prevented from sucking the tobacco oil. Moreover, the smoking end 11 can be prevented from being polluted when the tobacco oil being refueled to the bottle, and thus the user experience can be improved.

Figure 7:
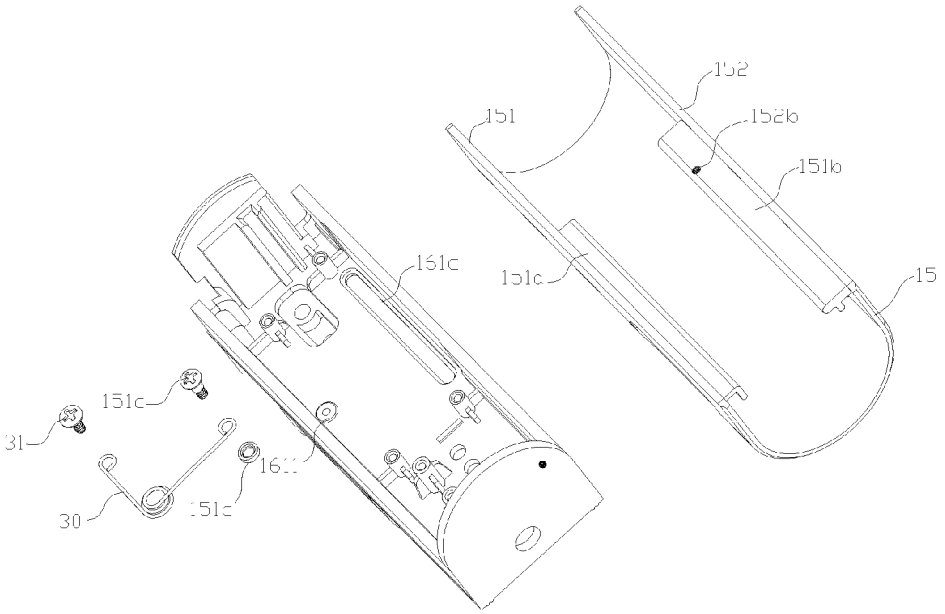
FIG. 7 illustrates a partially explored view of the electronic cigarette shown in FIGS. 6*a*-6*c;*

As shown in FIG. 7, in this embodiment, a sliding connecting mechanism (unlabeled) is arranged between the sheathing 15 and the main body 10. Specifically, the sliding connecting mechanism comprises a first coulisse 161*c* defined on the baffle 161 of the support 16 and a first sliding part 151*c* arranged on the sheathing 15. The shape of first coulisse 161*c* is to be a strip and an axis of the first coulisse 161*c* is configured to be parallel with that of the baffle 161. The first coulisse 161*c* runs through both sides of the baffle 161. A sliding path is formed when the first sliding part 151*c* is configured to slide in the first coulisse 161*c* in an axial direction of the first coulisse 161*c*. A connecting line between a connecting point connecting the elastic part 30 to the main body 10 and the critical position is perpendicular to an axis of the first coulisse 161*c*.

Figure 8:
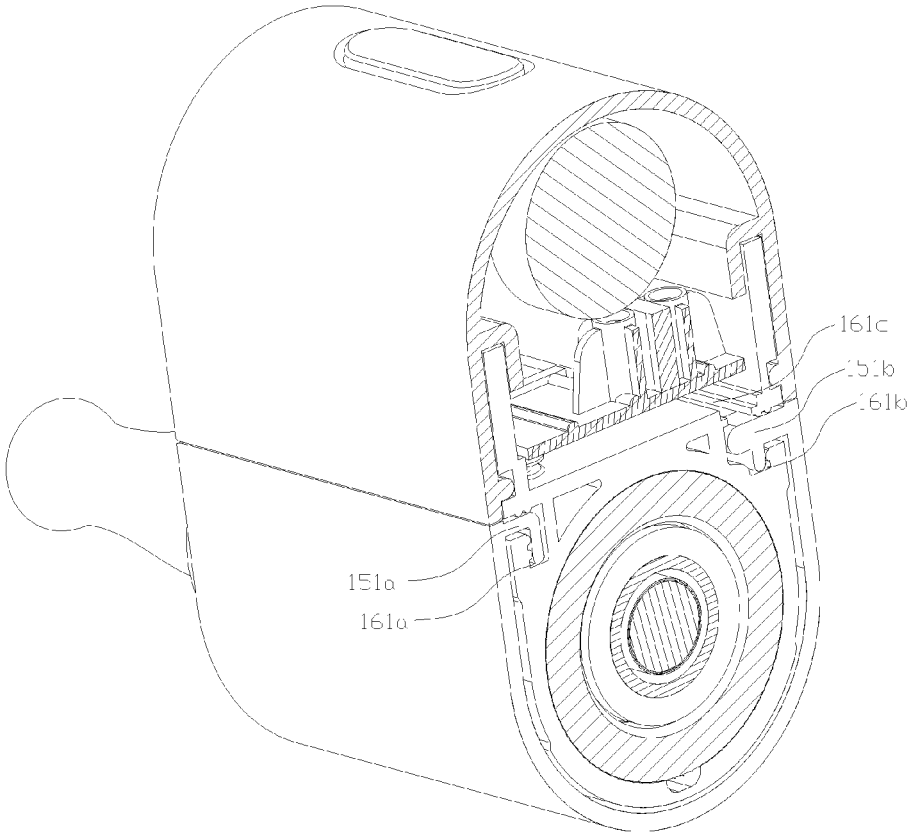
FIG. 8 illustrates a structure of the electronic cigarette shown in FIGS. 6*a*-6*c* from another visual angle.

Furthermore, the shape of the sheathing 15 is arcuate and tabular. Preferably, the angle subtended by an arc of the cross section of the sheathing 15 is 180 degree. The sheathing 15 comprises a first side 151 and a second side 152 which are parallel with each other. In this embodiment, a third sliding part 151*a* and a second sliding part 151*b* are arranged along the first side 151 and the second side 152 respectively. The shape of the cross section of the third sliding part 151*a* is an L shape and the shape of the cross section of the second sliding part 151*b* is a T shape. Correspondingly, as shown in FIG. 8, a third coulisse 161*a* and a second coulisse 161*b* parallel with each other are arranged at a junction between the second mounting part 163 and the baffle 161. The third coulisse 161*a* is fit to the third sliding part 151*a* with sliding connection and the second coulisse 161*b* is fit to the second sliding part 151*b* with sliding connection. It is helpful to keep the sheathing 15 stable and hence prevent the sheathing 15 from being separated from the support 16.

The first coulisse 161*c* is configured to directly face the second sliding part 151*b*. The first sliding part 151*c* is perpendicularly arranged on one side of the second sliding part 151*b* and the side of the second sliding part 151*b* is facing the first coulisse 161*c*. The first sliding part 151*c* extends from the first coulisse 161*c* in a direction away from the second mounting part 163. The first sliding part 151*c* is preferred to be a screw bolt or a screw nail and is screwed into a screw hole 152*b* of the second sliding part 151*b*. A connecting part 31 is fixedly arranged on a surface of the baffle 161 and the surface of the baffle 161 is away from the second mounting part 163. Preferably, the connecting part 31 is a screw bolt or a screw nail screwed into a screw hole 1611 of the baffle 161. One end of the elastic part 30 is sheathed into the connecting part 31 and the other end of the elastic part 30 is sheathed into a part of the second sliding part 151*b* that is extended from the first coulisse 161*c*.

Figure 9A:
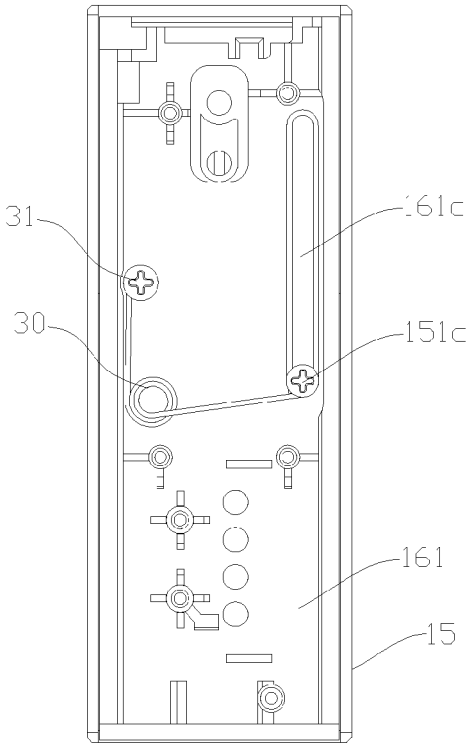
FIG. 9*a* illustrates a partial view of the electronic cigarette when in the state shown in FIG. 6*a;*
Figure 9B:
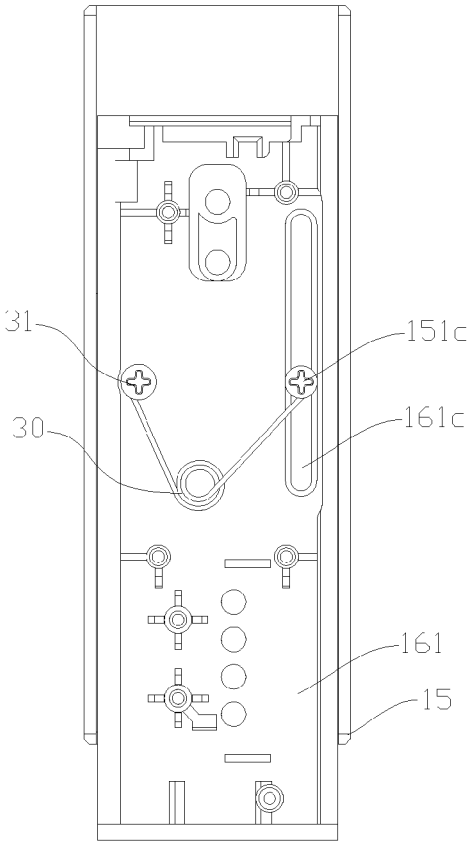
FIG. 9*b* illustrates a partial view of the electronic cigarette when in the state shown in FIG. 6*b;*
Figure 9C:
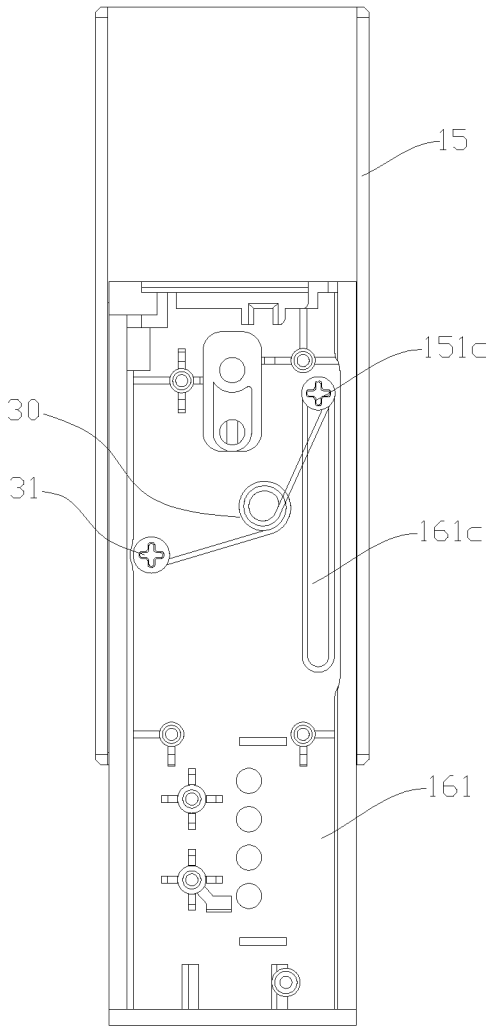
FIG. 9*c* illustrates a partial view of the electronic cigarette when in the state shown in FIG. 6*c;*
Figure 10A:
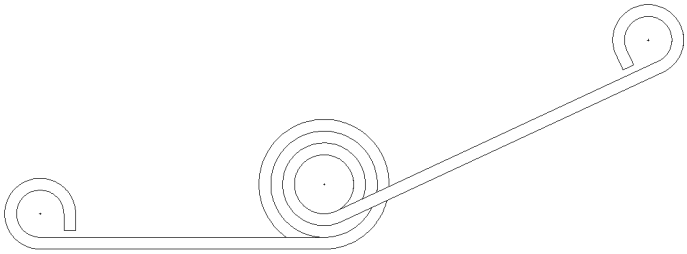
FIG. 10*a* illustrates a first structure of an elastic part of the electronic cigarette shown in FIGS. 6*a*-6*c;*
Figure 10B:
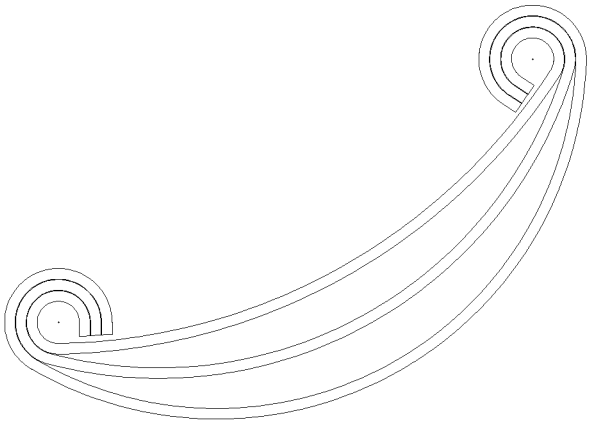
FIG. 10*b* illustrates a second structure of the elastic part of the electronic cigarette shown in FIGS. 6*a*-6*c;*
Figure 10C:
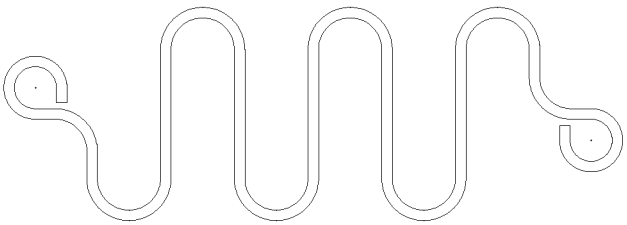
FIG. 10*c* illustrates a third structure of the elastic part of the electronic cigarette shown in FIGS. 6*a*-6*c.*

In this embodiment, a connecting sleeve in a shape of a ring is arranged on two ends of the elastic part 30. The connecting sleeve is used to sleeve one end of the elastic part 30 to the connecting part 31 and sleeve the other end of the elastic part 30 to the first sliding part 151*c*. Referring to FIGS. 9*a*, 9*b* and 9*c* at the same time, one end of the elastic part 30 is sleeved to a portion of the first sliding part 151*c* that is extended from the first coulisse 161*c* while the other end of the elastic part 30 is sleeved to the connecting part 31, thus making one end of the elastic part 30 connected to the sheathing 15 and the other end of the elastic part 30 connected to the main body 10. FIGS. 9*a*, 9*b* and 9*c* are respectively corresponding to the electronic cigarette in the states as shown in FIGS. 6*a*, 6*b* and 6*c*. Preferably, when the first sliding part 151*c* is positioned at one of the axial ends of the first coulisse 161*c*, the sheathing 15 is in an open or closed state and the elastic part 30 is in a compressed state. Therefore, the elastic part 30 provides resilience keeping the sheathing 15 in the open or closed state for the sheathing 15, thus further preventing the sheathing 15 from being opened or closed by a mistaken operation. It should be understood that the elastic part 30 may be a torsion-spring (shown in FIG. 10*a*), an arc spring (shown in FIG. 10*b*) or a waved spring (shown in FIG. 10*c*). Without doubt, the shape and type of the elastic part 30 is not limited to these.

In the present application, via the arrangement that the battery assembly is arranged in parallel with the bottle and the atomization assembly and the arrangement that the resilient electrical connection component is arranged between the atomization assembly and the battery which are hence resiliently connected, easy assembly, convenient disassembly as well as stable and reliable electrical connection can be realized in the electronic cigarette. The electronic cigarette is well designed for short length, convenient to be taken along and strong mechanical strength. In additional, the diameter of this electronic cigarette is larger, hence the enjoyment for sucking and holding is increased and it is more suitable for satisfying the psychological need of the smokers who are used to the cigarette with large diameter such as cigar. The electronic cigarette cannot be broken easily under external force. The case that the battery assembly is shorted under the influence of tobacco oil can be avoided. Since the bottle is arranged at one end of the main body and the end of the body is away from the smoking end, the smoke doesn't flow through the oil stored region. Therefore, the damage that the user sucks tobacco oil caused by oil leakage due to the tobacco oil permeating the smoke passageway, by smoke condensation due to its heat absorbed by the tobacco oil, and by the tobacco oil pulled into the smoke passageway under the sucking force, can be avoided effectively. The possibility that the user sucks the tobacco oil has reduced greatly.

Moreover, since the bottle is detachably arranged in the atomizer, it is convenient for the user to refuel or replace tobacco oil with different flavor. Meanwhile, since the sheathing is connected to the main body via a sliding connection, the bottle can be protected from being broken when it is oscillated during transportation or in use. Since the elastic part can provide resilience in a direction toward the other terminal of the sliding path for the sheathing when the sheathing is slid from one terminal to the other terminal of the sliding path, it is convenient for using and operating and can prevent from a mistaken operation. Since the bottle is detachably arranged at the external of the main body, it is convenient to replace the bottle. As the bottle is away from the smoking end, it can prevent the user from sucking the tobacco oil and it can also prevent the smoking end from being polluted by the tobacco oil when refueling the tobacco oil to the bottle. In additional, since the sheathing is in an open or closed state and the elastic part is in a compressed state when the first sliding part of the electronic cigarette of the present application is positioned at each of the two terminals of the sliding path, the elastic part can provide resilience for the sheathing to keep the sheathing in the open or closed state, and further prevent the sheathing from being opened or closed by a mistaken operation.

While the present invention has been described with reference to preferred embodiments, the present application is not limited to above specific embodiments which are only illustrative, but not for the purpose of limiting. It will be understood by those skilled in the art that various changes may be made and equivalents may be substituted under the inspiration of the present application without departing from the scope of the present invention. However, all the changes and equivalents will be included within the scope of the appended claims.

The invention claimed is:

1. An electronic cigarette, comprising a main body (10); a smoking end (11), an atomization assembly (13) configured for atomizing tobacco oil, and a battery assembly (14) configured for powering the atomization assembly (13) are arranged on the main body;

wherein a bottle (12) configured for storing the tobacco oil is arranged at one end of the main body and the end of the main body is away from the smoking end (11), the atomization assembly (13) is arranged between the smoking end (11) and the bottle (12) and the bottle (12) is arranged in parallel with the battery assembly (14); and wherein an electrical connection component (144) is arranged between the battery assembly (14) and the atomization assembly (13), one end of the electrical connection component (144) is connected to the battery assembly (14) while the other end of the electrical connection component (144) is resiliently abutted against a side wall of the atomization assembly (13), the electrical connection component (144) is configured for providing an electrical connection between the battery assembly and the atomization assembly;

wherein the smoking end (11), the atomization assembly (13) and the bottle (12) are coaxially arranged; one end of the atomization assembly (13) is inserted into the bottle (12), and the atomization assembly (13) comprises a first electrode component (135) configured for resiliently abutting against the electrical connection component (144); and wherein the bottle (12) comprises an opening into which the atomization assembly (13) is inserted; the atomization assembly (13) comprises an atomization cavity (134) for containing a heating wire component (131), and an oil guiding mechanism inserted into the bottle (12) and configured for guiding the tobacco oil to the heating wire component (131); the first electrode component (135) configured to be hollow and electrically connected to the heating wire component (131) is arranged on the atomization cavity (134); and the first electrode component (135) is communicated with the atomization cavity (134).

2. The electronic cigarette of claim 1, wherein the first electrode component (135) comprises a first external electrode (1351) and a first internal electrode (1350) which are configured to be hollow and insulated from each other, wherein the first internal electrode (1350) is partly inserted into the first external electrode (1351), and one end of the heating wire component (131) is connected to the first internal electrode (1350) while the other end of the heating wire component (131) is connected to the first external electrode (1351).

3. The electronic cigarette of claim 2, wherein the electrical connection component (144) comprises a first electrode (1440) and a second electrode (1441) which are configured to be insulated from each other; one end of the first electrode (1440) is electrically connected to the battery assembly (14) while the other end of the first electrode (1440) is resiliently abutted against the first internal electrode (1350), and one end of the second electrode (1441) is electrically connected to the battery assembly (14) while the other end of the second electrode (1441) is resiliently abutted against the first external electrode (1351).

4. The electronic cigarette of the claim 3, wherein the first electrode and/or the second electrode are pogo pin electrodes or leaf spring electrodes.

5. The electronic cigarette of claim 3, wherein the oil guiding mechanism comprises an oil guiding tube (133) and an oil latching part (132), wherein the oil latching part (132) is made of oil absorbing material and contained in the oil guiding tube (133); an outer circumferential surface of the oil latching part (132) is fit to an inner circumferential surface of the oil guiding tube (133); the first external electrode (1351) is sheathed in one end of the oil guiding tube (133) and is fit to the oil guiding tube (133); and the second electrode (1441) is resiliently abutted against the first external electrode (1351) through being resiliently abutted against a side wall of the oil guiding tube (133).

6. The electronic cigarette of claim 5, wherein the heating wire component (131) is contained in the oil guiding tube (133); the first electrode component (135) electrically connected to the battery assembly (14) is inserted into one end of the oil guiding tube (133); the heating wire component (131) is electrically connected to the first electrode component (135); and a smoke passageway communicated with the smoking end (11) is formed in the main body (10) and configured for discharging smoke atomized by the heating wire component (131).

7. The electronic cigarette of claim 6, wherein the heating wire component (131) comprises a liquid guiding part (1312) arranged in an extending way towards an axial direction of the oil guiding tube (133), and a heating wire (1311) wound around the liquid guiding part (1312); one end of the liquid guiding part (1312) is abutted against the oil latching part (132), and the heating wire (1311) is electrically connected to the first electrode component (135).

8. The electronic cigarette of claim 7, wherein structures of the oil latching part (132) and the liquid guiding part (1312) both are configured to be solid and cylindrical; an axis line of the oil latching part (132) is configured to be superposition with or parallel to an axis line of the liquid guiding part (1312); and cross sectional area of the oil latching part (132) is bigger than cross sectional area of the liquid guiding part (1312).

9. The electronic cigarette of claim 5, wherein the battery assembly (14) comprises a battery (141) and a control circuit board (142) connected to the battery (141), and the first electrode (1440) and the second electrode (1441) both are electronically connected to the battery (141) via the control circuit board (142).

10. The electronic cigarette of claim 9, wherein the main body (10) further comprises a support (16), the battery assembly (13) is arranged in the support (16), the atomization assembly (13) is arranged in one end of the support (16) and the end of the support (16) adjoins to the smoking end (11);

the support (16) comprises a baffle (161) arranged between the battery assembly (14) and the bottle (12); mounting holes corresponding to the first electrode (1440) and the second electrode (1441) respectively are defined on the baffle (161); and the first electrode (1440) and the second electrode (1441) are movably mounted in corresponding mounting holes respectively.

11. The electronic cigarette of claim 9, wherein the electronic cigarette further comprises a key component connected to the control circuit board (142); the key component is at least partially exposed from an outside wall of the electronic cigarette; and the key component is configured for controlling an electrical connection between the electrical connection component (144) and the battery (141) according to an external trigger signal to control atomization of the atomization assembly (13) to the tobacco oil in the bottle (12).

12. The electronic cigarette of the claim 9, wherein the electronic cigarette further comprises a display panel (20) configured for displaying information of the electronic cigarette, and the display panel (20) is arranged on the main body (10) and electrically connected to the control circuit board (142).

13. The electronic cigarette of claim 12, wherein the information of the electronic cigarette includes at least one of the following information: remaining capacity of the battery assembly, the number of puff from the electronic cigarette, the number of the electronic cigarette to be powered on, flavor of the tobacco oil and manufacturer.

14. An electronic cigarette, comprising a main body (10); a smoking end, an atomization assembly (13) configured for atomizing tobacco oil, and a battery assembly (14) configured for powering the atomization assembly (13) are arranged on the main body; wherein a bottle (12) configured for storing the tobacco oil is arranged at one end of the main body and the end of the main body is away from the smoking end (11), the atomization assembly (13) is arranged between the smoking end (11) and the bottle (12) and the bottle (12) is arranged in parallel with the battery assembly (14);

wherein an electrical connection component (144) is arranged between the battery assembly (14) and the atomization assembly (13), one end of the electrical connection component (144) is connected to the battery assembly (14) while the other end of the electrical connection component (144) is resiliently abutted against a side wall of the atomization assembly (13), the electrical connection component (144) is configured for providing an electrical connection between the battery assembly and the atomization assembly;

wherein the battery assembly (14) comprises a battery (141) and a control circuit board (142) connected to the battery (141); the electrical connection component (144) is arranged at a side of the control circuit board (142) and the side of the control circuit board (142) is facing the atomization assembly (13); one end of the electrical connection component (144) is electrically connected to the control circuit board (142) while the other end of the electrical connection component (144) is resiliently abutted against a first electrode component (135);

wherein a sliding connecting mechanism is defined between the main body (10) and a sheathing (15); the sliding connecting mechanism comprises a first coulisse (161*c*) arranged on the main body (10) and a first sliding part (151*c*) arranged on the sheathing (15); the first sliding part (151*c*) is configured to slide in the first coulisse (161*c*) in an axial direction of the first coulisse (161*c*) to form a sliding path; a critical position is defined between two terminals of the sliding path; when the first sliding part (151*c*) is positioned between one terminal of the sliding path and the critical position, an elastic part (30) is configured to provide resilience in a direction toward the one terminal for the sheathing (15); a connecting line between a connecting point connecting the elastic part (30) to the main body (10) and the critical position is perpendicular to an axis of the first coulisse (161*c*);

wherein the elastic part (30) is in compressed state when the first sliding part (151*c*) is positioned at an upper end of the first coulisse (161*c*);

wherein the main body (10) further comprises a support (16); the battery assembly (14) is arranged in the support (16); the atomization assembly (13) is arranged in one end of the support and the end of the support (16) adjoins to the smoking end (11); the bottle (12) is detachably connected to the support (16); the smoking end (11), the atomization assembly (13) and the bottle (12) are coaxially arranged; and wherein the support (16) comprises a baffle (161), a first mounting part (162) arranged at one side of the baffle (161), and a second mounting part (163) arranged at the other side of the baffle (161); the battery assembly (14) is mounted in the first mounting part (162); the second mounting part (163) is shaped to be hollow tubular; a second internal threaded joint (19) is defined in one end of the second mounting part (163) and the end of the second mounting part (163) is close to the smoking end (11); a first internal threaded joint (17) is defined in the other end of the second mounting part (163) and the other end of the second mounting part (163) is away from the smoking end (11); and the bottle (12) is screwed to the first internal threaded joint (17) and the smoking end (11) is screwed to the second internal threaded joint (19).

15. An electronic cigarette, comprising a main body (10); a smoking end (11), an atomization assembly (13) configured for atomizing tobacco oil, and a battery assembly (14) configured for powering the atomization assembly (13) are arranged on the main body;

wherein a bottle (12) configured for storing the tobacco oil is arranged at one end of the main body and the end of the main body is away from the smoking end (11), the atomization assembly (13) is arranged between the smoking end (11) and the bottle (12) and the bottle (12) is arranged in parallel with the battery assembly (14); and wherein an electrical connection component (144) is arranged between the battery assembly (14) and the atomization assembly (13), one end of the electrical connection component (144) is connected to the battery assembly (14) while the other end of the electrical connection component (144) is resiliently abutted against a side wall of the atomization assembly (13), the electrical connection component (144) is configured for providing an electrical connection between the battery assembly and the atomization assembly; and wherein the bottle (12) is detachably and externally arranged on the main body (10);

the electronic cigarette further comprises an elastic part (30) and a sheathing (15) configured to protect the bottle (12), wherein the sheathing is connected to the main body (10) with a sliding connection; one end of the elastic part (30) is connected to the sheathing (15) while the other end of the elastic part (30) is connected to the main body (10); and in the process that the sheathing (15) is slid from one terminal to the other terminal of a sliding path, the elastic part (30) is configured to provide resilience in a direction toward the other terminal of the sliding path for the sheathing (15).

16. The electronic cigarette of claim 15, wherein a sliding connecting mechanism is defined between the main body (10) and the sheathing (15); the sliding connecting mechanism comprises a first coulisse (161*c*) arranged on the main body (10), and a first sliding part (151*c*) arranged on the sheathing (15) and inserted into the first coulisse (161*c*); and the first sliding part (151*c*) is configured to slide in the first coulisse (161*c*) in an axial direction of the first coulisse (161*c*) to form the sliding path.

17. The electronic cigarette of claim 16, wherein a critical position is define between two terminals of the sliding path; when the first sliding part (151*c*) is positioned between one terminal of the sliding path and the critical position, the elastic part (30) is configured to provide resilience in a direction toward the terminal for the sheathing (15); and a connecting line between a connecting point connecting the elastic part (30) to the main body (10) and the critical position is perpendicular to an axis of the first coulisse (161*c*).

18. The electronic cigarette of claim 16, wherein the elastic part (30) is in compressed state when the first sliding part (151*c*) is positioned at an upper end of the first coulisse (161*c*).

* * * * *